US005299328A

United States Patent [19]

Walega

[11] Patent Number: 5,299,328

[45] Date of Patent: Apr. 5, 1994

[54] WATER CLOSET WITH RETRACTABLE URINAL

[76] Inventor: Wayne Walega, 10 Jane La., Mattapoisett, Mass. 02739

[21] Appl. No.: 857,330

[22] Filed: Mar. 25, 1992

[51] Int. Cl.[5] ..... E03D 9/06; E03D 13/00

[52] U.S. Cl. ..... 4/341; 4/342

[58] Field of Search ..... 4/312, 340, 341, 342, 4/307, 144.1

[56] References Cited

U.S. PATENT DOCUMENTS

| | | | |
|---|---|---|---|
| 274,288 | 6/1984 | Shanks | D23/49 |
| 2,611,134 | 9/1952 | Jarrett et al. | 4/312 |
| 2,750,599 | 6/1956 | Colonna | 4/312 |
| 3,500,480 | 3/1970 | Michal, Jr. | 4/102 |
| 3,742,522 | 7/1973 | Stevenson | 4/307 |
| 3,822,419 | 7/1974 | Wilson, Sr. | 4/1 |
| 4,549,321 | 10/1985 | Douillard | 4/301 |
| 5,153,947 | 10/1992 | Markles | 4/342 |

FOREIGN PATENT DOCUMENTS

| | | | |
|---|---|---|---|
| 3742760 | 8/1988 | Fed. Rep. of Germany | 4/415 |
| 2434242 | 4/1980 | France | 4/307 |
| 304130 | 12/1990 | Japan | 4/307 |

*Primary Examiner*—Henry J. Recla
*Assistant Examiner*—Charles R. Eloshway
*Attorney, Agent, or Firm*—Fish & Richardson

[57] ABSTRACT

A water closet includes a urinal disposed adjacent to a stationary bowl which is movable between a retracted position and a used position in which the urinal is arranged to receive liquid waste. The urinal is pivotally mounted to the water closet to allow the urinal to be pivoted between the retracted position and the used position. In one embodiment, the urinal pivots about a horizontal axis, while in another embodiment the urinal pivots about a vertical axis. In both embodiments, the use position is disposed forwardly of the retracted position with to respect to the user, and when in the retracted position the urinal is disposed in a recess in the tank of the water closet. A plunger-activated valve is mounted on the tank to supply a limited amount of water (such as one pint) to the urinal for flushing when the urinal is returned to the retracted position.

34 Claims, 7 Drawing Sheets

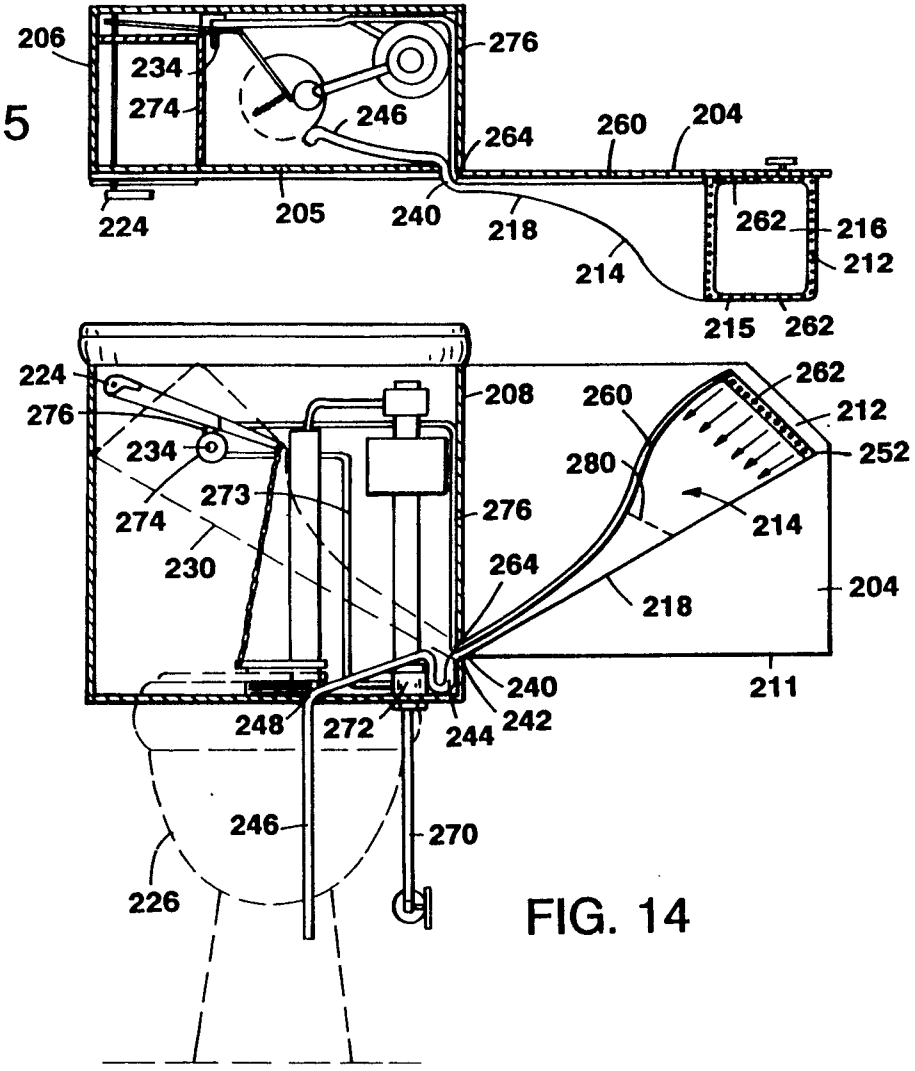
FIG. 15
FIG. 14
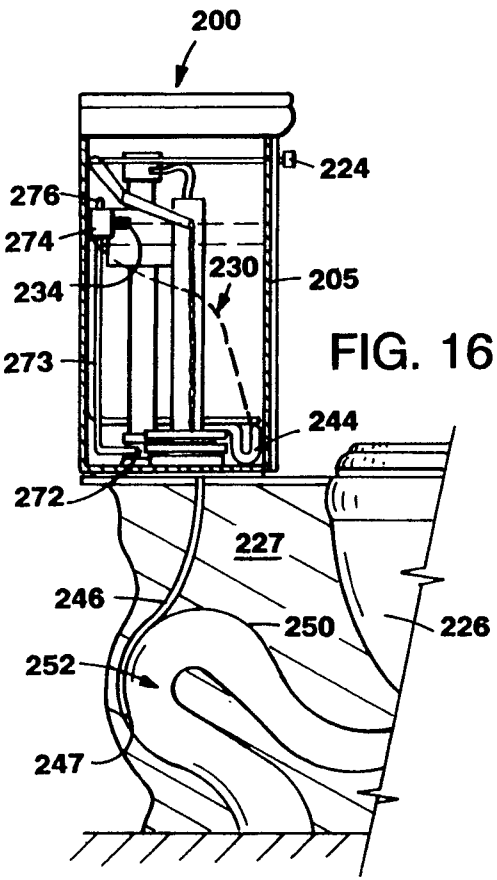
FIG. 16

WATER CLOSET WITH RETRACTABLE URINAL

BACKGROUND OF THE INVENTION

This invention relates to water closets.

Typical water closets (also known as toilets) include a stationary bowl for receiving liquid and solid human waste. A seat is provided over the bowl to allow persons to sit on the water closet during use. The seat is generally pivotally mounted to the water closet to allow it to be repositioned away from the bowl opening during, e.g., male urination.

The waste is flushed from the bowl and removed through a drain using water stored in a tank mounted to the bowl Typically, large amounts of water (such as between 1½ gallons and 4½ gallons) are used during flushing.

SUMMARY OF THE INVENTION

This invention, in one general aspect, features a water closet that includes a urinal disposed adjacent to a stationary bowl and that is movable between a retracted position and a used position in which the urinal is arranged to receive liquid waste.

Preferred embodiments include the following features.

The urinal is pivotally mounted to the water closet to allow the urinal to be pivoted between the retracted position and the used position. In one embodiment, the urinal pivots about a horizontal axis, while in another embodiment the urinal pivots about a vertical axis. In both embodiments, the use position is disposed forwardly of the retracted position with to respect to the user. In the vertical axis case, the urinal is disposed on a hinged door on the tank, and the tank includes a recess for receiving the urinal in the retracted position.

An opening in the urinal for receiving the liquid waste is exposed only when said urinal is in the used position. The tank of the water closet is recessed to receive the urinal when retracted and cover the opening. The urinal includes a channel for receiving water from a supply (such as the water supply line of the water closet), and a plurality of openings arranged around the urinal interior are coupled to the channel to allow the liquid waste to be flushed away via a conduit in the urinal. Preferably, the urinal and bowl use the same drain. The conduit includes a water trap to inhibit unpleasant septic odors. The trap is configured to maintain water therein as the urinal is moved between the retracted and use positions.

A valve mounted in the tank is selectively actuated to couple water from the supply to the urinal during flushing. The valve is disposed to be actuated by the urinal when the urinal is moved to the retracted position. Preferably, the valve is triggered by a plunger mounted in the recess of the tank so that flushing occurs when the user pivots the urinal into the retracted position. The valve is constructed to couple a limited amount of water—approximately one pint—to the urinal during flushing. A so-called "timer" valve may be used for this purpose.

Among other advantages, the retractable urinal is hygienic. The urinal opening is disposed higher and closer to the source of urination than standard water closet bowls, which substantially reduces overspray onto the base of the bowl, the floor, and adjoining wall areas. The risk of damage (such as rusting) to nearby radiators and other metal structures caused by overspray is also avoided.

The retractable urinal is also easy to use. Less effort is required to pull the urinal forward from its retracted to its used position than to bend down to lift the seat up away from the bowl. Incidentally, the retractable urinal also helps eliminate the nuisance of the seat being left in the "up" position.

Moreover, the retractable urinal conserves water, because far less water is needed to flush the urinal than to flush the bowl. One reason for this is that the urinal is used for liquid waste only. But reduced water usage is also a result of using a valve separate from that used to empty the water closet tank during bowl flushing. This allows the minimum amount of water needed to effectively flush the liquid waste (such as one pint or less) to be applied to the urinal.

The retractable urinal is also less noisy to use than the bowl, for several reasons. First, the splashing noise that typically occurs during use of the bowl is not encountered, because the urinal does not contain a store of water. Instead the urine is guided down the solid surface of the urinal. This is important in small offices and residences where the bathroom is in close proximity to others. Moreover, the urinal is positioned higher than the bowl, cutting down on the length of urine flow.

The retractable urinal is also a simple replacement unit that does not require any redesign of a bathroom in which it is used. The retractable urinal can be disposed to either side of the bowl, and the exterior of the bowl can be contoured on both sides for a balanced, symmetrical appearance.

Other features and advantages of the invention will be apparent from the following detailed discussion, and from the claims.

BRIEF DESCRIPTION OF THE DRAWINGS

FIG. 14 is a partial sectional and diagrammatical frontal view showing the interior of the water tank of the water closet of FIG. 12 and a hinged door that holds the urinal.

FIG. 15 is a partial sectional and diagrammatical top view showing the interior of the water tank of the water closet of FIG. 12 and a hinged door that holds the urinal.

FIG. 16 is a partial sectional and diagrammatical side view showing the interior of the water tank of the water closet of FIG. 12 and the bowl drainage system.

DESCRIPTION OF PREFERRED EMBODIMENTS

Structure and Assembly

Figure 1:
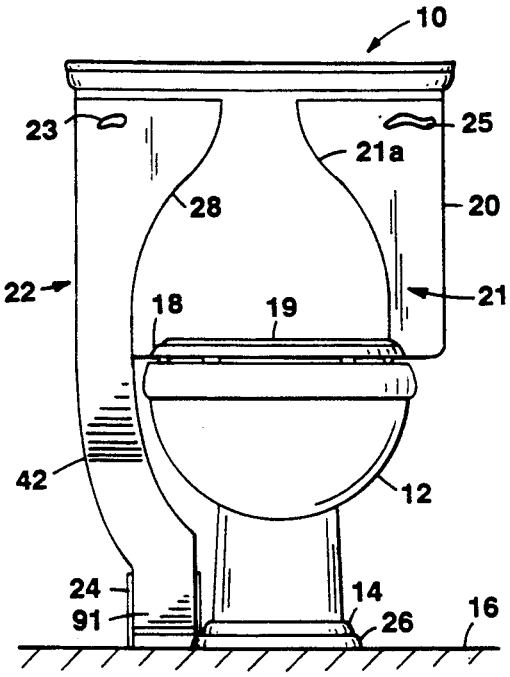
FIG. 1 is a front view of a water closet with retractable urinal according to one embodiment of the invention, showing a pivotable urinal in the retracted position.
Figure 3:
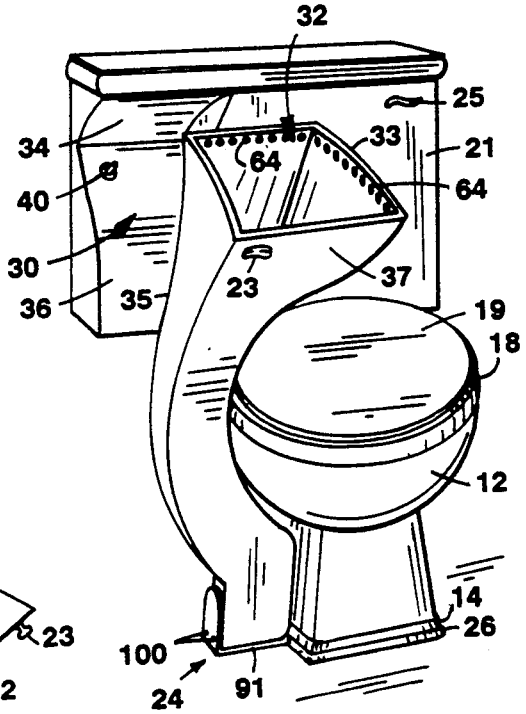
FIGS. 2 and 3 are a side and perspective views, respectively, of the water closet of FIG. 1, showing the urinal pivoted forward to the used position.
Figure 2:
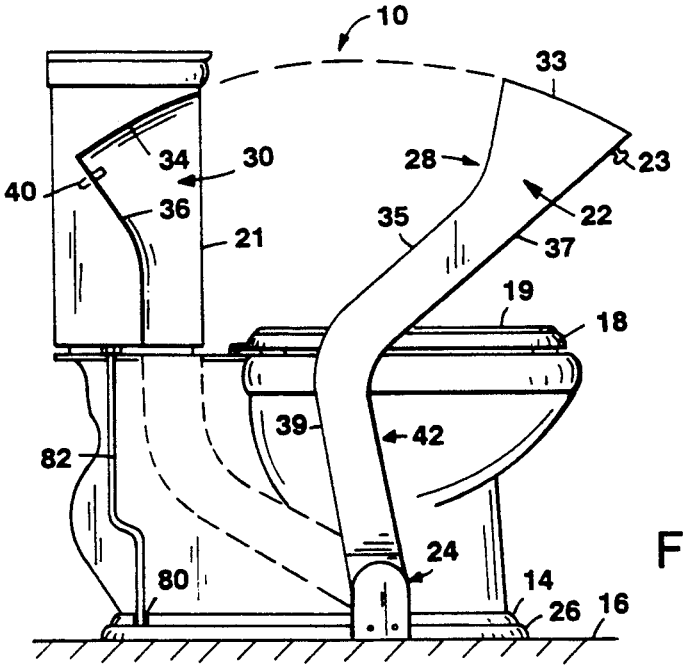

Referring to FIGS. 1-3, water closet 10 includes a stationary bowl 12 the base 14 of which is mounted to the floor 16 in a conventional manner. Attached to bowl 12 are a seat 18 and a lid 19, each of which is pivotable from a "down" position in which seat 18 and lid 19 are disposed over the rim of bowl 12 (shown in FIG. 1) to an "up" position in which seat 18 and lid 19 rest against the front surface 21 of water tank 20.

A retractable urinal 22 is disposed adjacent to bowl 12 and tank 20. (Urinal 22 is shown positioned to the left of bowl 12 and tank 20 in FIG. 1, but may alternatively be located to the right of the tank and bowl.) Urinal 22 is funnel-shaped and is pivotally mounted by assembly 24 (details of which are discussed below) to a baseplate 26 disposed under base 14 to allow urinal 22 to be moved from a retracted position (shown in FIG. 1) to a used position (shown in FIGS. 2 and 3) in which a person can urinate into urinal 22 through opening 32 while standing. In the use position, urinal 22 is disposed forwardly of tank 20 and near the user for convenience. A handle 23 attached to urinal 22 near its rim assists the user in pivoting urinal 22 about a generally horizontal axis between the retracted position and the forward position.

In the retracted position, an upper portion 28 of urinal 22 fits within a recess 30 in tank 20 so that an opening 32 in urinal 22 is covered by an interior surface 34 of tank 20. As a result, urinal opening 32 is hidden from view when urinal 22 is not in use. The shape of recess 30 is complementary to that of upper portion 28 of urinal 22. In particular, the interior surfaces 34, 36 of recess 30 are contoured identically to the rim 33 and rear surface 35, respectively of urinal 22. This helps provide a sleek appearance and avoids urinal 22 protruding from tank 20 when in the retracted position. Put another way, when urinal 22 is in the retracted position, its front surface 37 is substantially coextensive with front surface 21 of tank 20. As a design element, front surface 21 of tank 20 includes a surface detail 21*a* that mirrors the shape of the seam between urinal upper portion 28 and tank surface 21.

A plunger 40 is mounted on surface 36 of tank recess 30. As described in detail below with reference to FIG. 11, plunger 40 is depressed by urinal surface 35 when urinal 22 is returned to the retracted position after use, thereby causing a valve in tank 20 to open and supply water to urinal 22 to flush away urine (and other liquid waste) from the interior of urinal 22. The valve used to flush urinal 22 is separate from that used to flush bowl 12 (and which is controlled by handle 25 on tank 20). As discussed in detail below, the valve used to control flushing of urinal 22 is selected to apply a small amount of water (such as one pint), rather than the entire 1½ gallon to 4½ gallon contents of tank 20, to urinal 22 during flushing. This results in a substantial saving of water.

Viewed from the side (FIG. 2), urinal 22 is L-shaped, with the upper portion 28 and the lower portion 42 of urinal 22 defining an angle of about 120 degrees. This allows urinal opening 32 to be fully exposed for male urination when urinal 22 is in the forward position, while ensuring that lower portion 42 is disposed to the rear of and below bowl 12 (FIG. 4) when urinal 22 is in the retracted position. As a result, with urinal 22 retracted, lower portion 42 does not interfere with the normal use of bowl 12. Urinal 22 is C-shaped when viewed from the front (FIG. 1). This allows urinal 22 to pivot freely between the retracted and used positions without striking the side of bowl 12.

When urinal 22 is in the forward position, rim 33 is approximately 28 to 32 inches above floor 16, and is thus substantially closer to the source of urination than the rim of bowl 12 (which stands about 15 inches above the floor). This helps avoid overspray and reduces noise during use.

Figure 4:
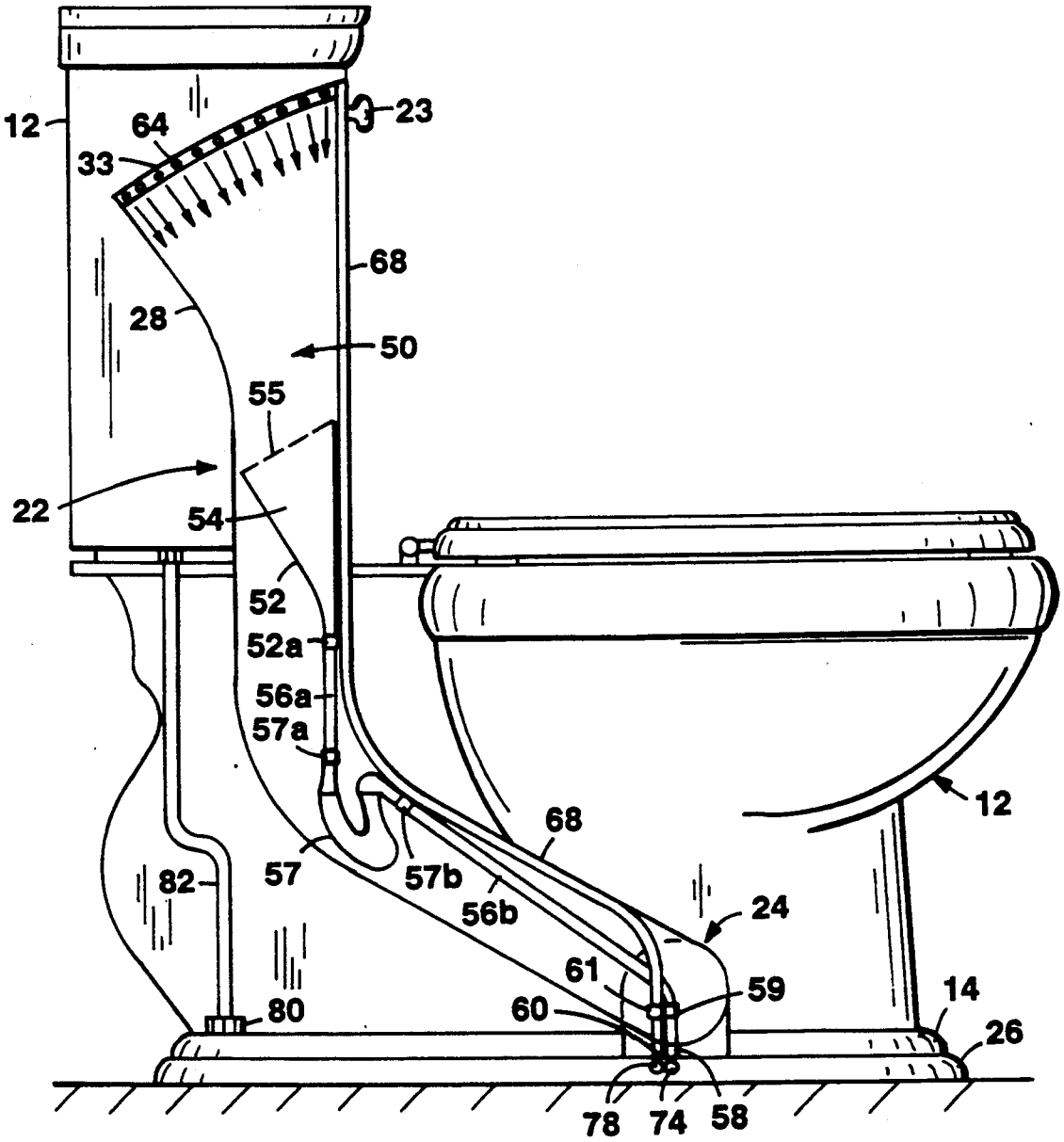
FIG. 4 shows details of the interior of the retractable urinal of FIG. 1.

FIG. 4 shows the interior 50 of urinal 22 as if its side surface had been removed. Urinal 22 is made from acrylic, ceramic, porcelain, fiberglass, or any other suitable material. A conduit 52 disposed within interior 50 receives urine and other liquid waste that enters urinal 22 during use. Conduit 52 is cast so that urinal 22 and conduit 52 are a single unit. (Alternatively, conduit 52 may be a separate element secured in place, such as by gluing, within interior 50.) A removable screen 55 placed over the upper edge of the enlarged portion of conduit 52 prevents solid objects (such as toilet tissue) from entering, and possibly clogging, conduit 52. The upper portion of conduit 52 is enlarged to provide an opening 54 having the same size as urinal interior 50. The lower portion of conduit 52 is connected with pipe clamp 52*a* to a drain tube 56*a* that is in turn fastened to a water trap 57 by a pipe clamp 57*a*.

Water trap 57 is somewhat S-shaped, and is configured and positioned within urinal 22 to contain water at all times—even when urinal 22 is pivoted to the forward position—to provide a water seal that blocks septic gases, thereby helping to avoid unpleasant odor. Although some water may escape from trap 57 when urinal 22 is moved, a sufficient amount of water remains in trap 57 to retain the water seal. Water trap 57 is made from a rigid or semirigid material, such as polystyrene.

Figure 9:
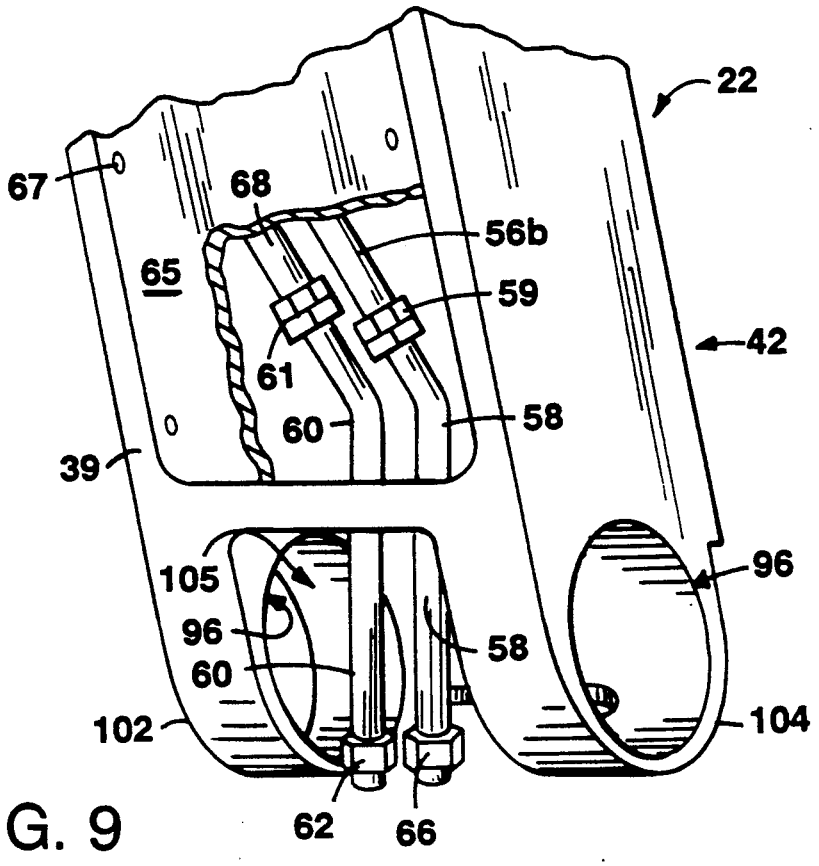
FIG. 9 shows an end of the retractable urinal that attaches to the mounting assembly of FIG. 8.

A second drain tube 56*b* is connected to the lower end of water trap 57 (by clamp 57*b*) and extends to the lower end of urinal 22. Drain tubes 56*a*, 56*b* can be either rigid or flexible. Materials from which drain tubes 56*a*, 56*b* can be made include polyvinylchloride (PVC), polyethelyne, and rubber. Drain tubes 56*a*, 56*b* are secured within urinal 22 by friction clips (not shown). The lower end of drain tube 56*b* is connected to a flexible hose 58 by a fitting 59 (FIG. 9). Hose 58 (which is, e.g., rubber) terminates in a fitting 66 for connection at base plate 26 in a manner described below.

Water for flushing urinal 22 is supplied to a flexible hose 60 (FIG. 9) via a fitting 62 connected at base 26. The upper end of hose 60 is attached by fitting 61 to a supply tube 68, which extends the entire length of urinal 22 to rim 33 and is permanently secured behind front surface 37. Supply tube 68 is cast within urinal 22 (it may alternatively be a separate element made from the same material as drain tubes 56*a*, 56*b*) and provides a channel through which water is applied to a series of openings 64 disposed around the perimeter of rim 33, thereby causing a flushing action down all sides of urinal interior 50. Water is collected by the enlarged portion of conduit 52, flows into water trap 57 via drain tube 56*a*, and then continues down drain tube 56*b*.

Access to the lower ends of drain tube 56*b* and supply tube 68 for assembly with hoses 58 and 60, respectively, and servicing is gained by removing an access plate 65 (FIG. 9) secured to the rear of urinal 22 by a set of screws 67.

Referring also to FIGS. 5–9, hose fittings 66, 62 are attached to corresponding fittings 70, 72, respectively, of urinal mounting assembly 24 and baseplate 26. Drainage from urinal 22 is carried through baseplate 26 by a pipe 74 (formed during casting of baseplate 26) to center drain 76, which is disposed directly under, and communicates with, the regular drainage line of water closet bowl 12. A second cast pipe 78 extends along the length of baseplate 26 between urinal supply fitting 72 and a rear fitting 80. Water is supplied to pipe 78 through a supply line 82 (FIGS. 2 and 4) in a manner to be described. Suffice it here to say that supply line 82 is attached to the underside of tank 20 and to rear fitting 80. Supply line 82 is not shown in FIG. 3. A pair of holes 86 in baseplate 26 provide alignment for bolting baseplate 26 and water closet bowl base 14 to the floor.

Figure 8:
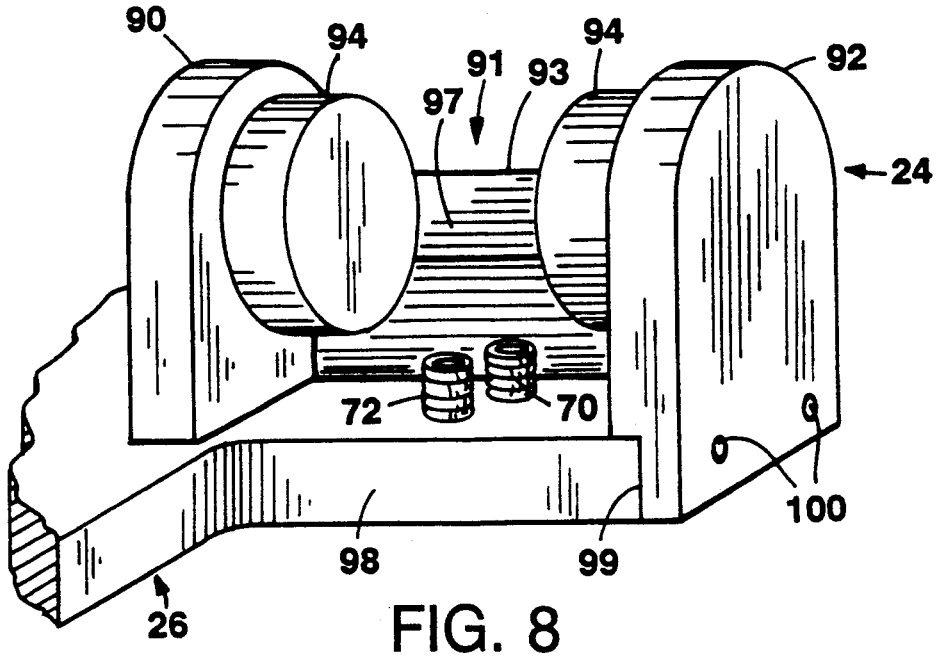
FIG. 8 shows a mounting assembly on the base plate of FIG. 5 for receiving the retractable urinal.
Figure 10:
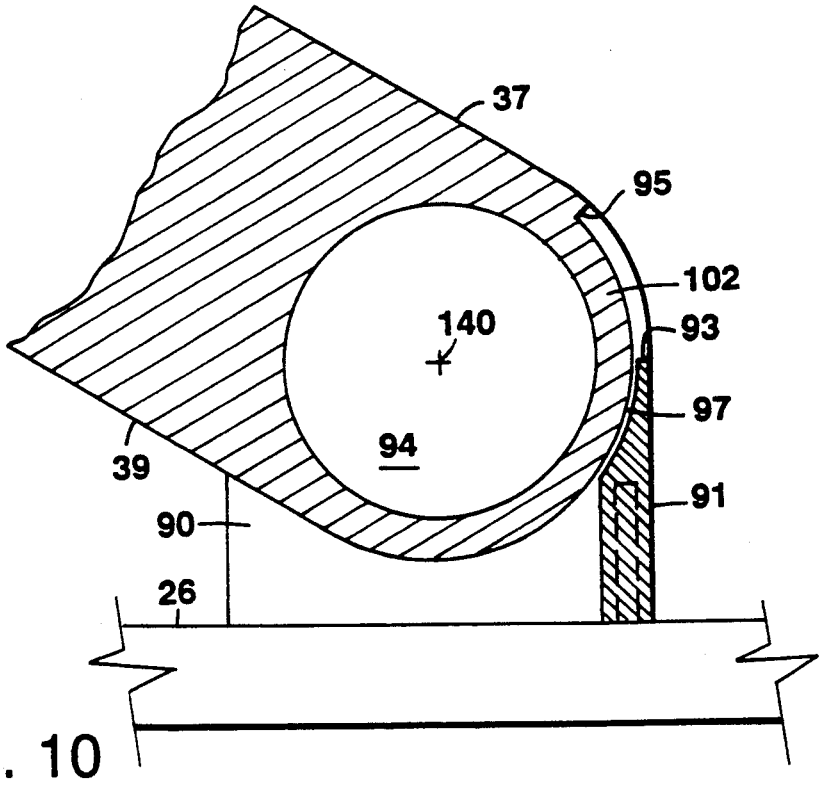
FIG. 10 is a partial sectional view of the urinal end of FIG. 9 connected to the mounting assembly of FIG. 8, illustrating a pivot stop.

Mounting assembly 24 is shown in detail in FIGS. 8–10 and includes a pair of brackets 90, 92 on baseplate 26 that are equipped with circular rims 94 for engaging corresponding circular openings 96 on the lower end of urinal 22. Each bracket and rim 90/94, 92/94 is a single unit for structural stability. Bracket 90 is permanently mounted to baseplate 26 adjacent to a side-extending arm 98 of baseplate 26. One or more screws (not shown) are advanced from the underside of baseplate 26 to attach bracket 90 to baseplate 26. (Alternatively, baseplate 26 and bracket 90 can be a single, molded unit.) Bracket 92 is detachably mounted to arm 98 at the end 99 of the arm by a pair of screws 100. Note that fittings 70, 72 project from the upper surface of arm between brackets 90, 92.

Figure 6:
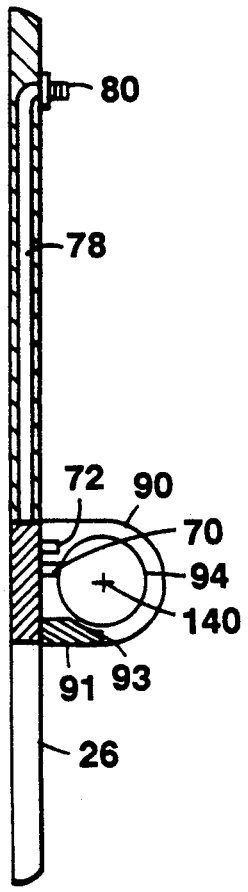
FIGS. 6 and 7 are side and front sectional views, taken along lines 6—6 and 7—7, respectively, of the base plate of FIG. 5.
Figure 5:
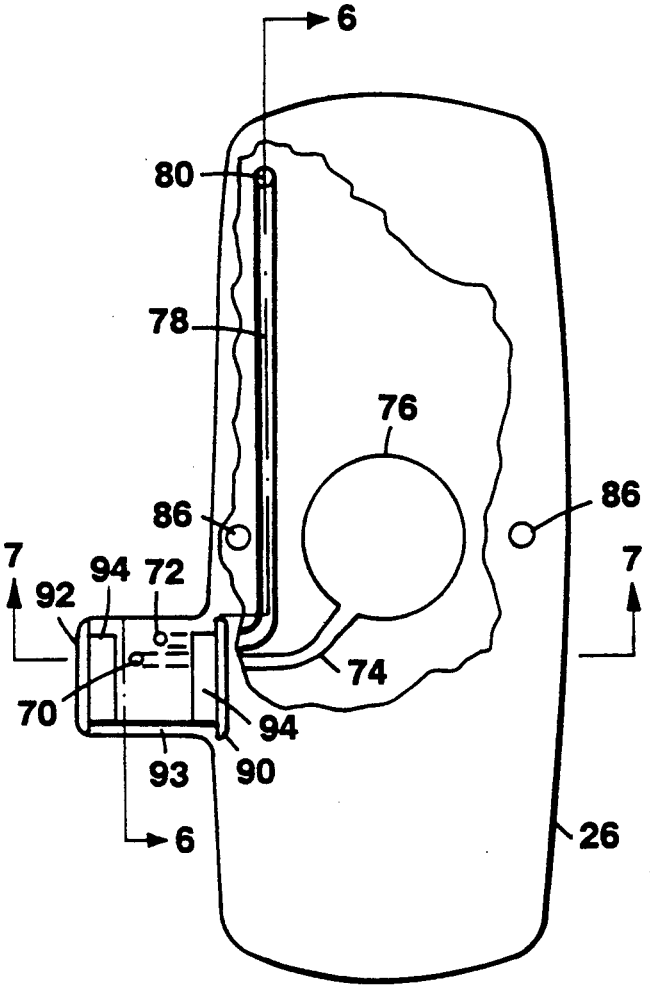
FIG. 5 is a top view, partially cut away, of the base plate of the water closet of FIG. 1.
Figure 7:
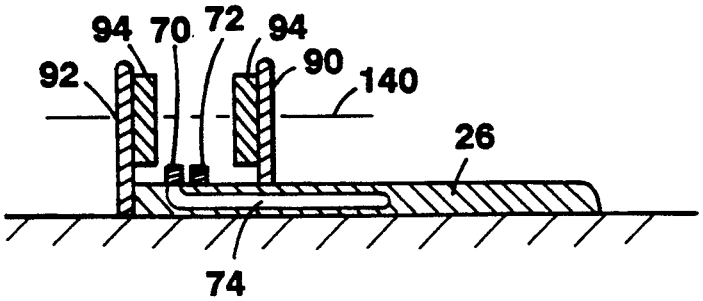

At the forward edge of arm 98 (i.e., the side of arm 98 that faces the user), brackets 90, 92 are connected together by plate 91 (also shown in FIGS. 1, 3 and 6). For structural stability, a mortise (not shown) at each end of plate 91 fits within a corresponding tenon (also not shown) in the respective bracket 90, 92. The upper surface 93 of plate 91 forms a ledge which engages a corresponding shoulder 95 on urinal 22 when urinal 22 is in its full forward position. Thus, plate 91 and shoulder 95 act as a stop to limit the forward position of urinal 22.

Lower portion 42 of urinal 22 is open at back surface 39 to provide access to hoses 58, 60 and their respective fittings, which are disposed within a cavity 105. A pair of rounded sleeves 102, 104 define the sides of cavity 105, and each sleeve 102, 104 includes a circular opening 96 that communicates with cavity 105 and receives a rim 94. Openings 96 are slightly larger in diameter than rims 94 to allow urinal 22 to pivot smoothly about rims 94 without binding or excessive play. A portion 97 of the inside surface of plate 91 is rounded to remain clear of sleeves 102, 104 as urinal 22 is pivoted. Lower portion 42 is solid across front surface 37 (FIG. 1) to shield hoses 58, 60 from view.

Urinal 22 is attached to mounting assembly 24 as follows. With bracket 92 detached from arm 98, urinal 22 is lowered over arm 98, and sleeve 102 is inserted onto rim 94 of bracket 90. Then, bracket 92 is placed on end 99 of arm 98 so that its rim 94 protrudes into opening 96 of sleeve 104 (and so that the mortise in bracket 92 slides over the corresponding tenon of plate 91). Bracket 92 is secured in place by screws 100. Either before or after bracket 92 is attached, fittings 58, 62 of urinal 22 are secured to fittings 70, 72, respectively, of arm 98. Cavity 105 facilitates access to fittings 58, 62 for attachment and removal. Rims 94 are elevated sufficiently above the upper surface of arm 98 to allow urinal 22 to be freely pivoted between the retracted and forward positions without striking and binding on arm 98.

Figure 11:
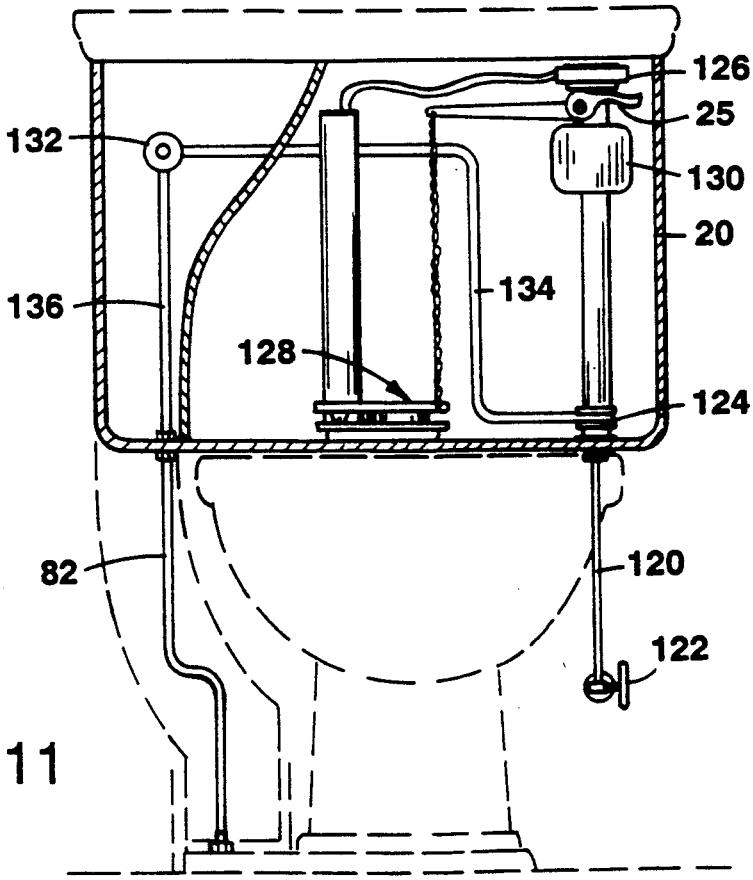
FIG. 11 is a partial sectional and diagrammatical view showing the interior of the water tank of the water closet of FIG. 1.

FIG. 11 illustrates how water is supplied to urinal 22 during flushing. Water is supplied to tank 20 in the usual way from a supply line 120 via a shut-off valve 122. A "T" shaped fitting 124 is attached to the water supply line in tank 20. One branch of the T provides water to the water filler valve 126 used during flushing of bowl 12. (Filler valve 126 is opened in the usual fashion during flushing of bowl 12: when handle 25 is depressed to release stopper 128 and flush water from tank 20 to bowl 12, float 130 falls with the decreasing water level, thereby opening valve 126. Float 130 also closes valve 126 when tank 20 has been re-filled sufficiently after flushing.)

The other branch of T fitting 124 provides water to an inlet of a timer valve 132 via a pipe 134. The outlet of timer valve 132 is coupled by pipe 136 to the urinal supply pipe 82 attached to the underside of tank 20. Timer valve 132 is mounted to recess surface 36 (FIG. 3) of tank 20 so that a plunger 40 on valve 132 protrudes through surface 36 for actuation when urinal 22 is returned to the retracted position after use. Timer valve 132 can be any commercially available valve that, when triggered, opens for a limited time to allow a predetermined amount of water (such as one pint) to flow therethrough before closing.

Operation

When not in use, urinal 22 is stored in its retracted position (shown in FIGS. 1 and 4). To use urinal 22, the user simply grasps handle 23 and pulls urinal forward, causing urinal 22 to pivot about horizontal axis 140 (FIGS. 7, 10) defined by rims 94 of mounting assembly 24 until shoulder 95 engages plate surface 93 (FIG. 10). Urinal 22 rests in the forward position with opening 32 (FIG. 3) positioned for convenient use. The L-shape of urinal 22 assures that it conveniently remains in the forward position without having to be held in place. Flexible hoses 58, 60 bend freely while urinal is moved between the retracted and forward positions.

Rim 33 and interior 50 are so located that a male standing in front of urinal 22 can urinate at a much shorter range to urinal than into bowl 12. This (as well as the absence of standing water that is present within bowl 12) substantially decreases noise during use. Moreover, the short distance to urinal 22 drastically reduces the risk of unsightly and unsanitary overspray. Lid 19 and seat 18 may (and preferably do) remain closed (i.e., in the "down" position) during use of urinal 22.

When use is complete, the user simply returns urinal 22 to the retracted position by pushing urinal 22 toward tank 12 and into recess 30 against surfaces 34, 36. The weight of urinal 22 causes rear surface 35 to depress plunger 40, thereby triggering timer valve 132 (FIG. 11) to open and release a pint of water. The water is channeled through pipes 136, 82, and 78 and into urinal supply tube 68 via hose 62, which in turn directs the water to rim 33 and distributes the water to peripheral openings 64. As a result, the water thoroughly rinses urinal interior 50 during the flushing process. After passing through conduit 52, trap 57, drain tubes 56*a*, 56*b*, and hose 58, the water (and the urine and other liquid waste carried by the water) drains out through baseplate 26 via pipe 74, and is disposed of via the water closet waste pipe to which drain 76 is connected.

Alternatively, after use urinal 22 can be left in the forward position and can be flushed by depressing plunger 40 by hand. In either case, water is conserved during flushing because only a limited amount of water (rather than, e.g., the entire contents of tank 12) is applied by valve 132. Avoiding use of the tank water during flushing further reduces noise. Thorough flushing is attained by supplying valve 132 with water from supply line 120 (FIG. 11), within which water is maintained at, for example, 40 psi.

Other embodiments are within the following claims.

For example, baseplate 26 may be acrylic and configured as a stand, and pipes 74, 78 (FIGS. 5–7) formed from PVC tubing glued to the underside of baseplate 26 between baseplate 26 and the floor. Baseplates 14, 26 can be a single (e.g., cast) unit. Urinal 22 and plate 91 (FIG. 10) can be configured to provide several pivot stops to allow adjustment of the forward position of urinal 22.

Other devices may be used in place of handle 23. For example, a foot pedal may be positioned near mounting assembly 24 for use in pivoting urinal 22 from the retracted position to the forward position.

Moreover, other techniques may be used for mounting the urinal to allow it to be moved between a retracted position and a position for use.

Figure 12:
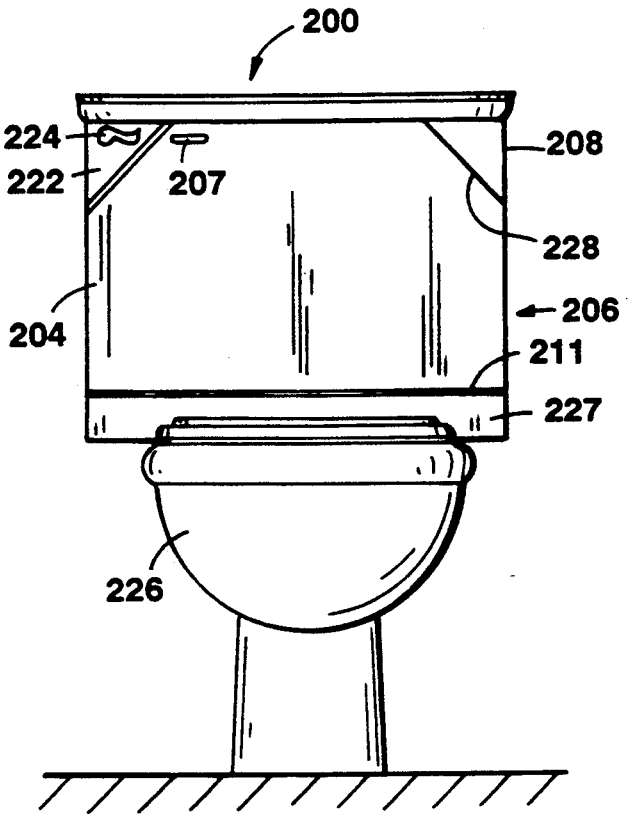
FIG. 12 is a front view of a water closet with retractable urinal according to another embodiment of the invention, showing a hinged urinal in the retracted position.
Figure 13:
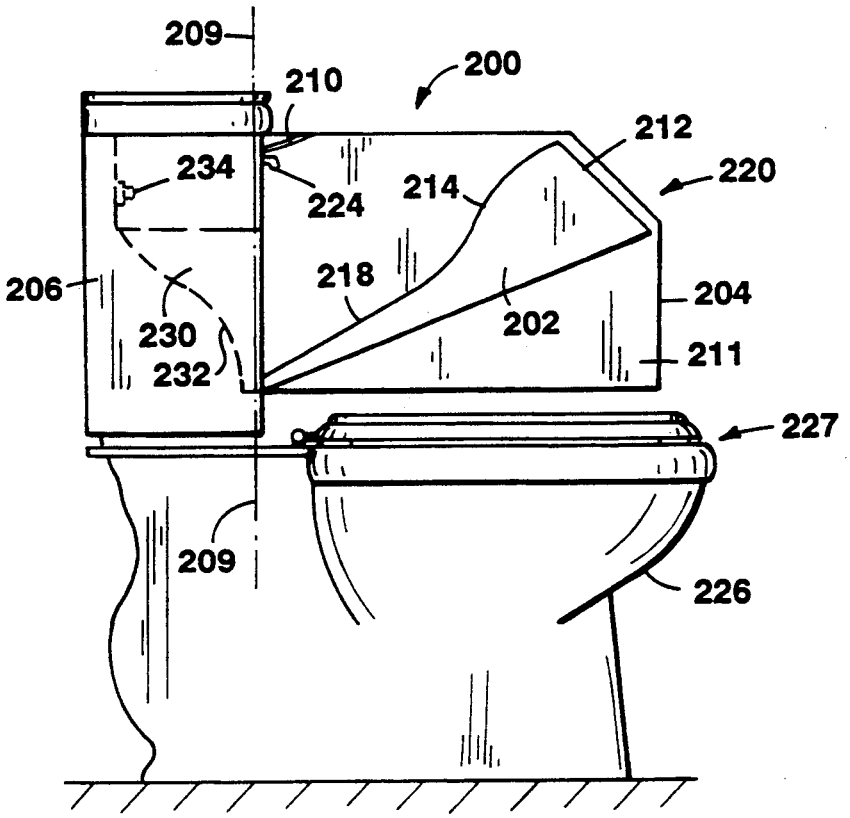
FIG. 13 is a partially cut-away side view of the water closet of FIG. 12, showing the hinged urinal open to the used position.

For example, referring to FIGS. 12 and 13, water closet 200 includes a urinal 202 carried by a hinged door 204 attached to tank 206. Door 204 is closed in FIG. 12 and open in FIG. 13. Urinal 202 and door 204 comprise a single, molded unit of, e.g., ceramic, porcelain, or acrylic, but they may be made from separate elements instead, with urinal 202 adhered to the rear surface of door 204. Door 204 is attached to tank 206 at the front right edge thereof by a hinge 208 that extends the length of door 204 along a vertical axis 209 about which door 204 pivots. The lower edge 211 of door is elevated with respect to toilet lid and seat 227 so that the seat and lid, when closed, do not interfere with the operation of door 204.

A handle 207 located near the upper left corner of door is used to open and close door and thereby swing urinal 202 between its retracted position and its forward or use position. A stop 210 connected to tank 206 and door 204 serves to limit the range of movement of door 204 to 90° with respect to the front of tank 206, and to latch door 204 in the forward position during use. (A right-hinged door 204 is shown, but door 204 may alternatively be hinged on the left.)

Near its rim 212, urinal 202 is funnel-shaped 214, with an enlarged opening 216 (FIG. 14) for ease of use. Funnel 214 narrows to a throat 218 near the lower end of urinal 202. Urinal 202 is pitched at approximately 30° with respect to the floor for efficient drainage, but of course other angles are possible. Rim 212 is also inclined to provide an easy to use opening 216 for urination. The upper corner 220 of door 204 is relieved to allow door 204 to close securely over the front of tank 206 without interference from a triangle-shaped projection 222 on which handle 224 (used to flush bowl 226 in the usual manner) is mounted. A surface detail 228 on door 204 mirrors the seam between door 204 and projection 222 to provide a symmetrical appearance.

As shown in FIG. 13, a cavity 230 complementary in shape to urinal 202 is formed in tank 206. Thus, when door 204 is closed to move urinal 202 to its retracted position, urinal 202 becomes disposed in cavity 230, thereby allowing door 204 to fit snugly against tank 206. Door 204 is held closed by a friction catch or magnetic latch (not shown). A plunger 234 for a timer valve 274 (FIG. 14) is disposed on the contoured surface 232 of cavity 230. Thus, urinal 202 depresses plunger 234 when returned to the retracted position, thereby causing flushing to occur in a manner similar to that described above. Water for flushing bowl 226 is stored in tank 206 behind and around cavity 230.

Referring also to FIGS. 14 and 15 (which illustrate door 204 positioned past its fully open position as if door stop 210 had been removed) and FIG. 16, the lower portion of urinal throat 218 is connected (such as by a hose clamp, not shown) to a flexible hose 240 that is inserted through the front wall 205 of tank 204 via a seal 242 (e.g., a rubber grommet) that prevents water from escaping from tank 204. Hose 240 is connected to a water trap 244, which in turn feeds a tube 246 which extends through a seal 248 in the bottom of tank 204 and empties into the waste line 250 of toilet bowl 226. (Tube 246 is formed during casting of bowl 226 and its support 227.) Tube 246 intercepts waste line 250 downstream of trap 252 so that the end 247 is not submerged in the water held by trap 252. This prevents urine and other liquid waste flushed from urinal 202 from backflowing through waste line 250 into bowl 226.

Water is supplied to urinal 202 for flushing through a channel 260 formed in (or securely attached to) urinal 202. Channel 260 is disposed below the upper surface of and extends along the entire length of urinal 202. Channel 260 feeds a series of holes 262 formed around the entire periphery of rim 212. Near the lower end of urinal 202, channel 260 is connected (by a hose clamp, not shown) to a flexible hose 264 that extends through the front wall of tank 204. Preferably, hoses 240, 264 share the same opening in tank 204 and the same seal 242. Hoses 240, 264 and seal 242 are covered by a grommet (not shown) for a clean appearance.

The water for flushing urinal 202 is derived from supply line 270. A T fitting 272 disposed in the supply line within tank 206 supplies water via tube 273 to the inlet of a timer valve 274 mounted with plunger behind cavity surface 232. The outlet of valve 274 feeds one end of tube 276, the opposite end of which is clamped to hose 264.

In operation, the user moves urinal 202 from its retracted position to its use position simply by opening door 204. Door stop 210 prevents door 204 from opening excessively, and also holds door 204 (and hence urinal 202) in place during use. With door 204 open, urinal opening 216 is positioned directly in front of (and close to) the user for convenience and sanitary purposes. When the user has finished, he returns urinal 202 to the retracted position by closing door 204 against tank 206, thereby positioning urinal 202 within cavity 230. (Alternatively, hinge 208 may be spring loaded to close door 204 when the user disengages stop 210.)

When urinal 202 has fully entered cavity 230, the rear surface 215 of funnel 214 depresses plunger 234, thereby actuating timer valve 274. Timer valve 274 responds by releasing one pint of water, which flows through tube 276, hose 264, and channel 260 to rim 212, where the water escapes through holes 262 and washes the urine and other liquid waste down funnel 214 to throat 218. A removable screen 280 disposed in the lower region of funnel 214 prevents large objects from being carried into (and clogging) throat 218. The waste water flows through hose 240, through water trap 244, and tube 246, and into waste line 250 for disposal. Water trap 244 blocks septic odors from being released into the interior of urinal 202.

Still other embodiments are within the scope of the claims.

I claim:

1. A water closet of the kind that includes a stationary bowl for receiving liquid and solid waste and constructed to flush said liquid and solid waste to a waste outflow pipe with water from a supply, said water closet comprising a urinal disposed adjacent to said bowl, said urinal being movable between a retracted position and a used position in which said urinal is arranged to receive said liquid waste, said bowl and urinal being constructed to flush said liquid waste from an interior of said urinal with water from said supply, and a device engaged by said urinal for selectively applying the water to flush said urinal in response to movement of said urinal to its retracted position.

2. The water closet of claim 1 wherein said urinal is pivotally mounted to said water closet to allow said urinal to be pivoted between said retracted position and said used position.

3. The water closet of claim 2 wherein said urinal is mounted to be pivoted about a horizontal axis and said used position is disposed forwardly of said retracted position with to respect to a user of said urinal.

4. The water closet of claim 2 wherein said urinal is mounted to be pivoted about a vertical axis and said used position is disposed forwardly of said retracted position with to respect to a user of said urinal.

5. The water closet of claim 4 further comprising a tank for storing water for flushing at least said liquid and solid waste from said bowl, said urinal being disposed on a hinged door on said tank, said tank including a recess for receiving said urinal in said retracted position.

6. The water closet of claim 1 wherein said urinal has an opening for receiving said liquid waste, said urinal being movable so that said opening is exposed when said urinal is in said used position and is not exposed when said urinal is in said retracted position.

7. The water closet of claim 1 further comprising a tank for storing water for flushing at least said liquid and solid waste from said bowl, said tank including a recess for receiving said urinal in said retracted position.

8. The water closet of claim 7 wherein said urinal has an opening for receiving said liquid waste when said urinal is in said used position, said recess being configured so that a portion of said tank covers said opening when said urinal is moved to said retracted position.

9. The water closet of claim 1 wherein said urinal includes a channel for receiving water from said supply and a plurality of openings arranged around said interior and coupled to said channel for flushing said liquid waste.

10. The water closet of claim 1 wherein said device includes a valve that is selectively actuated by engagement with said urinal to couple water from said supply to said urinal to flush said liquid waste from said urinal in response to movement of said urinal to said retracted position.

11. The water closet of claim 10 wherein said valve is disposed to be actuated by said urinal when said urinal is moved to said retracted position.

12. The water closet of claim 11 further comprising a tank for storing water for flushing at least said liquid and solid waste from said bowl, said valve including a switch mounted on said tank and positioned to be triggered by said urinal to actuate said valve when said urinal is moved to said retracted position.

13. The water closet of claim 12 wherein said tank includes a recess for receiving said urinal in said retracted position, said switch comprising a plunger disposed to be depressed by said urinal when said urinal is in said retracted position to actuate said valve.

14. The water closet of claim 10 wherein said valve is constructed to couple approximately one pint of water to said urinal to flush said liquid waste therefrom.

15. The water closet of claim 10 further comprising a tank, coupled by a pipe to said water supply, for storing water for flushing at least said liquid and solid waste from said bowl, said valve being connected to said pipe in said tank.

16. The water closet of claim 1 wherein said bowl includes a drain through which said liquid and solid waste are removed from said bowl, said urinal including a conduit for receiving said liquid waste when said urinal is in said used position, said conduit being coupled to said drain.

17. The water closet of claim 16 wherein said conduit includes a water trap.

18. The water closet of claim 17 wherein said water trap is configured to maintain a water seal as said urinal is moved between said retracted position and said used position.

19. The urinal of claim 1 further comprising an actuator that is positioned to cause said device to selectively apply water to flush said urinal in response to movement of said urinal to said retracted position.

20. A urinal for use with a water closet of the kind that includes a stationary bowl for receiving liquid and solid waste and constructed to flush said liquid and solid waste to a waste outflow pipe with water from a supply, said urinal being disposed adjacent to said bowl and being movable between a retracted position and a used position in which said urinal is arranged to receive said liquid waste, said urinal being mounted to said water closet below at least a portion of said bowl to pivot about a horizontal axis when moved between the retracted position and the used position.

21. The urinal of claim 20 wherein said water closet includes a tank for storing water for flushing at least said liquid and solid waste from said bowl, and further comprising a valve for coupling water from a supply thereof to said urinal to flush said liquid waste from said urinal, said valve including a switch mounted on said tank and positioned to be triggered by said urinal to actuate said valve and cause said urinal to be flushed when said urinal is moved to said retracted position.

22. The urinal of claim 20 wherein said bowl includes a base disposed below a portion of the bowl that receives the liquid and solid waste, said urinal being mounted to said base.

23. The urinal of claim 22 wherein said base serves as a stand to support said bowl.

24. A water closet of the kind that includes a stationary bowl for receiving liquid and solid waste and a tank for storing water for flushing at least said liquid and solid waste from said bowl through a drain, said water closet comprising a urinal having an opening for receiving said liquid waste, said urinal being mounted to said water closet adjacent to said bowl to allow said urinal to be moved between a retracted position in which said opening is not exposed and a used position in which said opening is exposed to receive said liquid waste, said tank including a recess for receiving said urinal in said retracted position, said recess being configured so that a portion of said tank covers said opening when said urinal is moved to said retracted position, and a valve for coupling water from a supply to said urinal to flush said liquid waste from said urinal through said drain, said valve including a plunger mounted on said tank in said recess and positioned to be depressed by said urinal when said urinal is moved to said retracted position for opening said valve to flush said urinal.

25. The water closet of claim 24 wherein said urinal is mounted to be pivoted about a horizontal axis and said use position is disposed forwardly of said retracted position with to respect to a user of said urinal.

26. The water closet of claim 24 wherein said urinal is pivotally mounted to said tank about a vertical axis and said use position is disposed forwardly of said retracted position with to respect to a user of said urinal, said tank including a recess for receiving said urinal in said retracted position.

27. The water closet of claim 24 wherein said valve is constructed to couple a approximately one pint of water to said urinal to flush said liquid waste therefrom.

28. A water closet of the kind that includes a stationary bowl for receiving liquid and solid waste, said bowl having side edges extending forwardly of said tank and terminating in a forward edge, and a tank for storing water for flushing at least said liquid and solid waste from said bowl, said water closet comprising a urinal disposed adjacent to said bowl, said urinal being movable between a retracted position and a used position in which said urinal is arranged to receive said liquid waste, said tank including a recess for receiving said urinal in said retracted position, and said urinal being pivotally mounted to said water closet so that said urinal is spaced laterally with respect to one of said side edges of said bowl when said urinal is in said used position and is received by said recess when said urinal is in said retracted position.

29. The water closet of claim 28 wherein said urinal is mounted to be pivoted about a horizontal axis and said used position is disposed forwardly of said retracted position with respect to a user of said urinal.

30. The water closet of claim 29 wherein said urinal is mounted below at least a portion of said bowl.

31. The water closet of claim 28 wherein said urinal is mounted to be pivoted about a vertical axis and said used position is disposed forwardly of said retracted position with to respect to a user of said urinal.

32. The water closet of claim 31 wherein said urinal is disposed on a hinged door on said tank.

33. A water closet of the kind that includes a stationary bowl for receiving liquid and solid waste, and a tank for receiving liquid from a pressurized source and constructed to flush at least said solid and liquid waste from said bowl to a waste outflow pipe, said water closet comprising:

a urinal disposed adjacent to said bowl, said urinal being movable between a retracted position and a used position in which said urinal is arranged to receive said liquid waste, and a mechanism for selectively applying liquid from said pressurized source to flush said urinal independently of applying liquid from said tank to flush said bowl.

34. The water closet of claim 33 wherein said urinal is constructed to flush liquid waste therefrom directly into said waste outflow pipe and not into said bowl.

* * * * *